US006197463B1

(12) United States Patent
Cais et al.

(10) Patent No.: US 6,197,463 B1
(45) Date of Patent: Mar. 6, 2001

(54) ELECTROPHOTOGRAPHIC PHOTOSENSITIVE BODIES

(75) Inventors: Rudolf E. Cais; Santanu Debnath, both of Virginia Beach, VA (US); Shinichi Suzuki; Moto Makino, both of Yokohama (JP)

(73) Assignees: Mitsubishi Chemical Corporation, Tokyo (JP); Mitsubishi Chemical America, Inc., White Plains, NY (US)

( * ) Notice: Subject to any disclaimer, the term of this patent is extended or adjusted under 35 U.S.C. 154(b) by 0 days.

(21) Appl. No.: 09/079,259

(22) Filed: May 15, 1998

(51) Int. Cl.[7] ..... G03G 5/047

(52) U.S. Cl. ..... 430/58.05; 430/56; 430/57.1; 430/66; 430/67

(58) Field of Search ..... 430/66, 67, 56, 430/58, 59, 57.1, 58.05

(56) References Cited

U.S. PATENT DOCUMENTS

| | | | |
|---|---|---|---|
| 3,652,269 | 3/1972 | Contois et al. . | |
| 3,915,735 | 10/1975 | Moreland | 106/308 D |
| 3,994,726 | 11/1976 | Wales | 156/84 |
| 4,148,637 | 4/1979 | Kubota et al. | 428/447 |
| 4,243,779 | 1/1981 | McAlister | 525/462 |
| 4,329,414 | 5/1982 | Suzuki | 430/103 |
| 4,338,388 | 7/1982 | Sakai et al. | 430/79 |
| 4,390,609 | 6/1983 | Wiedemann | 430/66 |
| 4,438,188 | 3/1984 | Shimatani et al. | 430/128 |
| 4,451,547 | 5/1984 | Hirai et al. | 430/128 |
| 4,481,270 | 11/1984 | Kubota et al. | 430/55 |
| 4,507,375 | 3/1985 | Hirai et al. | 430/128 |
| 4,519,698 | 5/1985 | Kohyama et al. | 118/652 |
| 4,634,647 | 1/1987 | Jansen et al. | 430/84 |
| 4,647,521 | 3/1987 | Oguchi et al. | 430/66 |
| 4,675,262 | 6/1987 | Tanaka | 430/945 |
| 4,678,731 | 7/1987 | Yoshizawa et al. | 430/65 |
| 4,713,308 | 12/1987 | Yoshizawa et al. | 430/65 |
| 4,713,309 | 12/1987 | Johncock et al. | 430/65 |
| 4,717,637 | 1/1988 | Yoshizawa et al. | 430/65 |
| 4,784,928 | 11/1988 | Kan et al. | 430/126 |
| 4,822,705 | 4/1989 | Fukagai et al. | 430/60 |
| 4,863,822 | 9/1989 | Fukagai et al. | 430/96 |
| 4,868,078 | 9/1989 | Sakai et al. | 430/67 |
| 4,869,982 | 9/1989 | Murphy | 430/48 |
| 4,937,166 | 6/1990 | Creatura et al. | 430/108 |
| 4,942,104 | 7/1990 | Kitajima et al. | 430/56 |
| 4,959,289 | 9/1990 | Nishikawa et al. | 430/64 |
| 5,021,309 | 6/1991 | Yu | 430/531 |
| 5,093,201 | 3/1992 | Ohtani et al. | 430/137 |
| 5,096,795 | 3/1992 | Yu | 430/60 |
| 5,141,836 | 8/1992 | Shirai et al. | 430/128 |
| 5,154,996 | 10/1992 | Makino et al. | 430/60 |
| 5,166,381 | 11/1992 | Teuscher et al. | 456/110 |
| 5,220,481 | 6/1993 | Swift et al. | 361/225 |
| 5,288,584 | 2/1994 | Yu | 430/128 |
| 5,385,796 | 1/1995 | Spiewak et al. | 430/64 |
| 5,389,477 | 2/1995 | Tsuchiya et al. | 430/78 |
| 5,529,869 | 6/1996 | Nguyen | 430/78 |
| 5,534,981 | 7/1996 | Ohno et al. | 430/109 |
| 5,554,473 | 9/1996 | Cais et al. | 430/96 |
| 5,605,778 | 2/1997 | Ohuma et al. | 430/110 |
| 5,610,690 | 3/1997 | Yoshihara et al. | 399/167 |
| 5,652,078 | 7/1997 | Jalbert et al. | 430/67 |
| 6,017,665 * | 1/2000 | Grune et al. | 430/58.2 |

FOREIGN PATENT DOCUMENTS

| | | | |
|---|---|---|---|
| 941559 | 11/1963 | (GB) | 430/66 |
| 63-210937 | 9/1988 | (JP) . | |
| 63-220156 | 9/1988 | (JP) | 430/56 |
| 4-310961 | 11/1992 | (JP) | 430/66 |
| 5-181299 | 7/1993 | (JP) . | |

OTHER PUBLICATIONS

Derwent Abstract AN 88–340451/48 of JP 63–220156 (Pub Sep, 1988) which is attached to the patent.

Japio Abstract AN 88–200156 of JP 63–220156 (Pub Sep. 1988).

Derwent Abstract AN 92–412579 of JP 4–310961 (Pub Nov. 1992).

Japio Abstract AN 92–310961 of JP 4–310961 (Pub Nov. 1992).

Grant, R. et al, ed., *Grant & Hackh's Chemical Dictionary*, Fifth Edition, McGraw–Hill Book Co, NY (1987) p. 116.*

Windholz, M. et al, ed., *The Merck Index*, Ninth Edition, Merck & Co., Inc. NJ (1976), pp 132 & 235.*

Patent & Trademark Office English–Language Translation of JP 63–220156 (Pub Sep. 13, 1988).

Patent & Trademark Office English–Language Translation of JP 63–210937 (Pub Sep. 1, 1988).

Patent & Trademark Office English–Language Translation of JP 4–310961 (Pub Nov. 2, 1992).

Patent & Trademark Office English–Language Translation of JP 5–181299 (Pub Jul. 23, 1993).

ACS File Registry No. 9005–02–1, Copyright 1999 ACS.

ACS File Registry No. 9004–99–3, Copyright 1999 ACS.

Caplus Abstract AN: 1995: 571298 of JP 07040656 (Pub Feb. 10, 1995).

Caplus Abstract AN: 1991: 517600 of GB 2237027 (Pub Apr. 24, 1991).

*Kirk–Othmer, Encyclopedia for Chemical Technology*, 4$^{th}$ ed., vol. 9, pp. 245–277, Wiley, New York (1994).

*Encyclopedia of Electronics*, 2$^{nd}$ ed., Gibilisco et al, Eds. pp. 669–671, Tab Books, Blue Ridge Summit, PA (1990).

* cited by examiner

*Primary Examiner*—Janis L. Dote

(74) *Attorney, Agent, or Firm*—Oblon, Spivak, McClelland, Maier & Neustadt, P.C.

(57) ABSTRACT

Electrophotographic photosensitive bodies which comprise a photosensitive layer on a conductive support, and which contain a wax having an ester group in their outermost layer, exhibit excellent durability and improved wear and printing resistance, without sacrificing their photosensitizability properties, such as chargeability and sensitivity, or ease and quality of application.

17 Claims, 1 Drawing Sheet

ELECTROPHOTOGRAPHIC PHOTOSENSITIVE BODIES

BACKGROUND OF THE INVENTION

Field of the Invention

The present invention relates to electrophotographic photosensitive bodies or drums used in copying machines, printers, etc. which employ an electrophotographic process. In particular, the present invention relates to electrophotographic photosensitive bodies or drums which can withstand long periods of repeated use without undergoing substantial wear, exhibit excellent cleaning and scratch resistance, and exhibit a high printing sensitivity.

Discussion of the Background

According to the electrophotographic image-forming process by Carlson, the surface of a photosensitive body is uniformly electrically charged, is exposed to light in accordance with information on an image to be formed, the electric charge is dissipated, and an electrostatic latent image is formed on the surface of the photosensitive body. The electrostatic latent image is developed and made visible by a toner, and the toner image is transferred from the photosensitive body onto transfer paper, etc., and fixed.

Next, the photosensitive body has its surface renewed by the removal of any residual toner and electric charge therefrom, and is repeatedly used. Therefore, the electrophotographic photosensitive body is not only required to have good chargeability and sensitivity, and photosensitive properties such as low attenuation, but is also required, for repeated, use to have good mechanical properties such as printing, wear and scratch resistance, and good resistance to destructive substances produced at the time of corona discharge, such as ozone, and ultraviolet radiation at the time of exposure.

Inorganic photoconductive materials, such as selenium, a selenium-tellurium alloy, arsenic selenide, cadmium sulfide and zinc oxide, have hitherto been widely used for the electrophotographic photosensitive body. These inorganic photoconductive materials are, however, harmful to the human body, and have had a problem of disposal, and the associated high costs thereof have been another problem.

For these reasons, a great deal of research has been performed on the use of organic photoconductive materials in photosensitive layers, because such organic photoconductive materials are less likely to cause environmental pollution and are easy to manufacture; and the practical use thereof has been promoted. Of main interest has been a laminated photosensitive body composed of a charge generating layer (CGL) and a charge transport layer (CTL) having the function of absorbing light and generating an electric charge as well as transporting the generated charge. These photosensitive bodies are widely used in the fields of copying machines, laser printers, etc.

Recent requirements of electrophotographic copying machines and printers have included the ability to create a large number of images rapidly, with continued ease of maintenance. In order to satisfy these requirements, it is essential to use a photosensitive body having a high printing sensitivity. However, electrophotographic photosensitive bodies which contain organic photoconductive materials have the drawback of poor mechanical properties and are more easily worn and damaged if used repeatedly, as compared with electrophotographic photosensitive bodies which contain inorganic photoconductive materials.

Decreasing the amount of the charge transport substance brings about a reduction of wear but also lowers the photosensitivity properties. The use of a binder having a higher molecular weight for the charge transport layer brings about a reduction of wear, but as the coating solution has a higher viscosity, defects such as sagging and unevenness are likely to arise from its application. There have been recent developments regarding dispersing inorganic filler, or lubricant particles in the charge transport layer, but the dispersed particles have the drawback of scattering incident light and thereby causing a serious decrease in sensitivity. Settling in the coating solution if it is left to stand, has also been shown, and there has not yet been available any electrophotographic photosensitive body having improved mechanical properties without the sacrifice of other properties such as photosensitizability and ease and quality of application and manufacture.

Thus, there remains a need for improved electrophotographic photosensitive bodies which exhibit extended lifetimes under operating conditions, without sacrificing sensitivity.

SUMMARY OF THE INVENTION

Accordingly, it is one object of the present invention to provide novel electrophotographic photosensitive bodies.

It is another object of the present invention to provide novel electrophotographic photosensitive bodies which exhibit an improved lifetime.

It is another object of the present invention to provide novel electrophotographic photosensitive bodies which exhibit reduced friction with the surfaces of the charge roller, toner, and wiper blade in a laser printer or photocopier cartridge.

It is another object of the present invention to provide novel electrophotographic photosensitive bodies which afford better image quality as a result of more homogeneous wear.

It is another object of the present invention to provide novel electrophotographic photosensitive bodies which exhibit improved scratch resistance.

It is another object of the present invention to provide novel electrophotographic photosensitive bodies which exhibit high photosensitivity.

It is another object of the present invention to provide novel electrophotographic photosensitive bodies which can withstand a long period of repeated use without undergoing substantial wear, and exhibit excellent cleaning and scratch resistance, while retaining other properties including electrical properties, commercial viability, and ease and quality of application.

These and other objects, which will become better understood during the course of the following detailed description, have been achieved by the inventors' discovery that electrophotographic photosensitive bodies, having a photosensitive layer on a conductive support, which contain a wax having an ester group in the outermost layer, exhibit improved wear and printing resistance without sacrificing their photosensitizability properties, such as chargeability and sensitivity, or ease and quality of application.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

In FIGS. 1–4 and 5*a*–*c*, the numeric descriptors have the following meanings:

Figure 1:
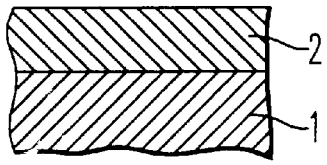
FIG. 1 is a cross-sectional view illustrating the construction of a photosensitive body containing a photosensitive layer consisting of a single layer.
Figure 2:
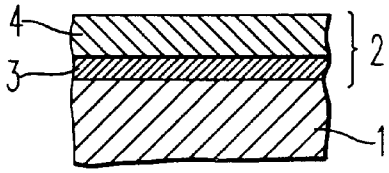
FIG. 2 is a cross-sectional view illustrating the construction of a photosensitive body containing a functionally divided type laminated photosensitive layer.
Figure 3:
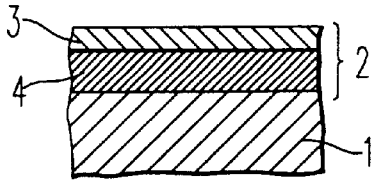
FIG. 3 is a cross-sectional view illustrating the construction of a photosensitive body containing a functionally reversed type laminated photosensitive layer.
Figure 4:
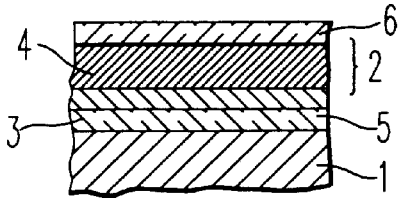
FIG. 4 is a cross-sectional view illustrating the construction of a laminated photosensitive body having a surface protective layer and an undercoat layer.

1 conductive support;

2 photosensitive layer;

3 charge generating layer;

4 charge transport layer;

5 undercoat layer; and 6 surface protective layer.

DETAILED DESCRIPTION OF THE PREFERRED EMBODIMENTS

Thus, the present invention provides electrophotographic photosensitive bodies having a photosensitive layer on a conductive support, which are characterized by containing a wax having an ester group in the outermost layer.

The wax used in the photosensitive bodies of the present invention has an ester group, and may be any wax having this structure in its molecule, but is preferably a wax in which at least one of the carboxylic acid and alcohol groups of the ester has from 12 to 40 carbon atoms, preferably from 16 to 40 carbon atoms. The greater the number of carbon atoms, the higher the melting point is, and the better the mechanical properties that can be obtained. However, precipitation is more likely to occur from the addition of a wax containing a large number of carbon atoms to the coating solution.

In the context of the present invention, the term carboxylic acid group of the ester means that portion of the wax molecule which includes the carbonyl group(s) and the group(s) attached to the carbonyl carbon atom(s) by a carbon—carbon bond; the term alcohol group of the ester refers to that portion of the wax molecule which includes the oxygen atom(s) singly bonded to the carbonyl carbon atom (s) and the group(s) linked to the carbonyl carbon atom(s) by the oxygen atom(s) singly bonded to the carbonyl carbon atom(s). For example, in: R—C(=O)—O—R', R—C(=O)—O—R"—O—C(=O)—R, and R'—O—C(=O)—R'"—C(=O)—O—R'; R—C(=O)— and —C(=O)—R'"—C(=O)— are carboxylic acid groups of the ester and —O—R' and —O—R"—O— are alcohol groups of the ester.

Waxes having two or more ester groups are preferable from the viewpoint of achieving an improved compatibility in the photosensitive layer. Preferred waxes having two or more ester groups can be obtained by a condensation reaction of a dialcohol (or polyalcohol) with a monocarboxylic acid or a condensation reaction of a dicarboxylic acid (or polycarboxylic acid) with a monoalcohol.

More preferably, the wax has a heat absorption peak in the range or 40° C. to 130° C., even more preferably 60° C. to 120° C., as measured by differential scanning calorimetry (DSC).

A specific example of a wax having one ester group is the compound of formula (I):

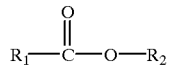

(I)

In formula (I), $R_1$ and $R_2$ are each a hydrocarbon group having one or more carbon atoms, and may be an aliphatic hydrocarbon group (linear, branched, saturated or unsaturated), an aromatic hydrocarbon group, or an alicyclic hydrocarbon group. Linear, saturated aliphatic hydrocarbon groups having from 11 to 40 carbon atoms, more preferably from 16 to 40 carbon atoms, are, among others, preferred. Examples of such waxes include cetyl palmitate, stearyl stearate, behenyl behenylate, cetyl myristate and palmityl hexadecylate.

Waxes having two or more ester groups are more preferably used in accordance with the present invention. Such waxes can usually be obtained by a condensation reaction of a dialcohol (or polyalcohol) with a monocarboxylic acid or a condensation reaction of a dicarboxylic acid (or polycarboxylic acid) with a monoalcohol. It is particularly preferable to use a wax formed from a carboxylic acid and an alcohol of which at least one has from 12 to 40 carbon atoms, more preferably from 16 to 40 carbon atoms. Glycerol, erythritol, pentaerythritol, etc. can be used as polyalcohols.

Specific examples of waxes which contain at least two ester groups include pentaerythritol tetrastearate, pentaerythritol tetrabehenate, pentaerythritol dibehenate, pentaerythritol tribehenate, neopentyl glycol dibehenate, a condensation product of nonanediol, sebacic acid and stearyl alcohol, and a condensation product of decanediol, azelaic acid and stearyl alcohol.

The amount of wax in the outermost layer of the present electrophotographic photosensitive bodies is preferably in the range of from 0.01 to 30% by weight, and more preferably from 0.1 to 10% by weight, based on the total solid weight of the outermost layer. If the amount of wax which is added to the outermost layer is too small, it has no effect on the mechanical properties, but if it is too large, it adversely affects the electrical properties, or gives an uneven coating surface. Incorporation of too much wax may also induce phase immiscibility leading to eventual inhomogeneous properties.

It is also possible to use two or more different kinds of waxes.

Preferably, the wax is incorporated into the outermost layer, at the time the outermost layer is formed. Thus, the wax is dissolved in the coating solution for the outermost layer, and the outermost layer is then applied by coating means to form an electrophotgraphic photosensitive body.

The construction of the electrophotographic photosensitive body of the present invention will now be described. The construction of layers of the photosensitive body according to this invention may be made by employing those proposed for the existing organic electrophotographic photosensitive bodies as shown in FIGS. 1 to 4.

The outermost or surface layer of the electrophotographic photosensitive body according to the present invention is its photosensitive layer as a whole if it is a single layer (FIG. 1) containing a charge generating agent and a charge transport agent. In the case of a functionally divided type laminated photosensitive body (FIG. 2) having a charge transport layer containing a charge transport agent formed on a charge generating layer containing a charge generating agent, the charge transport layer is the outermost or surface layer. In the case of a functionally reversed type photosensitive body (FIG. 3) having a charge generating layer formed on a charge transport layer, the charge generating layer is the outermost or surface layer. It is also possible to form a protective layer on a photosensitive layer (FIG. 4), and in this case, the protective layer is the outermost or surface layer.

The photosensitive layer is formed on a conductive support and the conductive support may be a metallic material, such as aluminum, stainless steel, copper, nickel, zinc, indium, gold or silver; or an insulating material, such as a polyester, or other polymer, paper or glass, having a conductive layer of e.g., aluminum, copper, palladium, tin oxide, indium oxide or a conductive polymer formed on its surface. The conductive support may have various kinds of surface treatments that do not affect the quality of images. For example, its surface may be oxidized or chemically treated. The support may, for example, be a metal drum having a surface oxidized by electrolytic oxidation. It may have any shape, such as a drum, belt, or seamless belt.

As the charge generating agent to be included in the photosensitive layer, it is possible to use inorganic photoconductive materials, such as selenium and its alloys, arsenic-selenium, cadmium sulfide, zinc oxide, cadmium sulfide, zinc sulfide, antimony sulfide, CdS—Se and other alloys, titanium oxide and other oxide semiconductors, amorphous silicon and other silicon-based materials, or organic pigments and colors, such as phthalocyanines, azo pigments, quinacridones, polycyclic quinones, perillene, indigo, thioindigo, anthanthrone, pyranthrone and cyanines.

It is particularly preferable to use nonmetallic phthalocyanine, phthalocyanines coordinated with metals, or oxides, chlorides or hydroxides, such as copper, indium chloride, gallium chloride, silicon, tin, oxytitanium, zinc and vanadium; or azo pigments such as monoazo, bisazo, trisazo and polyazo pigments. These charge generating agents may be used alone, or in combination with two or more kinds of materials.

As the charge transport agent to be included in the photosensitive layer, it is possible to use a high molecular compound such as polyvinyl carbazole, polyvinyl pyrene, polyacenaphthylene, polyvinyl pyrene or polyvinly anthracene, or a low molecular compound such as a pyrazoline derivative, a carbazole derivative, an oxazole derivative, a hydrazone derivative, a stilbene derivative, an arylamine derivative, and oxadiazole derivative, a thiazole derivative, a thiadiazole derivative, a triazole derivative, and imidazole derivative, an imidazolone derivative, an imidazolidine derivative, a styryl compound, a benzothiazole derivative, benzimidazole, an acridine derivative or a phenazine derivative. In addition to the charge transport agents of the positive-hole transport type as mentioned above, it is also possible to use a charge transport agent such as a benzoquinone derivative, a naphthoquinone derivative, an anthraquinone derivative, a diphenoquinone derivative or a fluorenone derivative, if required. These charge transport agents may be used alone, or in combination with two or more kinds of materials, depending on their combination with the charge generating agent, polarity, etc.

Suitable CTM are disclosed in U.S. Pat. Nos. 3,037,861, 3,232,755, 3,271,144, 3,287,120, 3,573,906, 3,725,058, 3,837,851, 3,839,034, 3,850,630, 4,746,756, 4,792,508, 4,808,506, 4,833,052, 4,851,314, 4,855,201, 4,874,682, 4,882,254, 4,925,760, 4,937,164, 4,946,754, 4,952,471, 4,952,472, 4,959,288, 4,983,482, 5,008,169, 5,011,906, 5,030,533, 5,034,296, 5,055,367, 5,066,796, 5,077,160, 5,077,161, 5,080,987, 5,106,713, 5,130,217, and 5,332,635, which are incorporated herein by reference. Preferred CTM include the diphenylhydrazone derivatives 1-pyrenealdehyle dyphenylhydrazone (PY—DPH) and 3-carbazolealdehyde diphenylhydrazone (CZ—DPH).

If the charge generating or transport agent to be included in the photosensitive layer has low film-forming capability, a binder polymer may be used to form a film thereof. In this case, a charge-generating layer can be formed by applying a coating solution prepared by dissolving or dispersing these materials and a binder polymer in a solvent, and drying it. Examples of the binder are butadiene, styrene, vinyl acetate, vinyl chloride, acrylic esters, methacrylic esters, vinyl alcohol, ethyl vinyl ether, or other polymers and copolymers of vinyl compounds, polyvinyl acetal, polycarbonates, polyesters, polyamides, polyurethanes, cellulose ethers, phenoxy resins, silicon resins and epoxy resins. They can also be crosslinked as by heat or light using an appropriate curing agent, etc. These binders may be used alone, or in a combination of two or more kinds of materials.

Although there is no particular limitation to the proportions of the charge generating agent and the binder polymer in the charge generating layer of a functionally divided type laminated photosensitive body, it is usual to employ 5 to 500 parts, and preferably 20 to 300 parts, by weight of binder polymer relative to 100 parts by weight of charge generating agent.

The charge generating agent is usually dispersed or dissolved in an adequate dispersing medium by a ball mill, ultrasonic disperser, paint shaler, attritor, sand grinder, etc., and the binder resin is added, if required, to prepare a coating solution. The coating solution is applied by a coating method such as dipping, spraying, or a bar coater, blade, roll coater, wire bard, or knife coater method, and dried. The charge-generating layer may also be formed by a vapor-phase film-forming process, such as the vapor deposition or sputtering of the charge-generating agent. The charge-generating layer is so formed as to have a thickness of 0.01 to 5 microns, and preferably 0.05 to 2 microns.

Although there is no particular limitation to the proportions of the charge transport agent and the binder polymer in the charge transport layer, it is usual to employ 10 to 500 parts, and preferably 30 to 300 parts, by weight of binder polymer relative to 100 parts by weight of charge transport agent. The charge transport layer can be formed by applying in the same way as the charge generating layer a coating solution obtained by dissolving the charge transport agent in an adequate solvent with any of the above polymers having excellent properties as a binder.

The charge transport layer has a thickness of usually 10 to 50 microns, and preferably 13 to 35 microns.

If the photosensitive layer is of the single-layer construction, it can be formed by applying in a similar way onto the substrate, a coating solution prepared by dissolving or dispersing not only the charge generating and transport agents and the binder polymer as mentioned above, but also additives, etc. in a solvent.

Examples of the solvent or dispersing medium to be used for application are butylamine, diethylamine, ethylenediamine, isopropanolamine, triethanolamine, triethylenediamine, N,N-dimethylformamide, acetone, methyl ethyl ketone, cyclohexanone, benzene, toluene, xylene, chloroform, 1,2-dichloroethane, 1,2-dichloropropane, 1,1,2-trichloroethane, 1,1,1-trichloroethane, trichloroethylene, tetrachloroethane, dichloromethane, tetrahydrofuran, dioxane, methyl alcohol, ethyl alcohol, isopropyl alcohol, ethyl acetate, dimethylsulfoxide and methyl cellosolve. These solvents may be used alone or as a mixed solvent prepared from two or more kinds of solvents.

It is possible to add an electron-attracting compound, plasticizer, pigment, or other additives, if required. Examples of the electron-attracting compounds are a cyano compound such as tetracyanoquinodimethane, dicyanoquinomethane or an aromatic ester having a dicyanoquinovinyl group; a nitro compound such as 2,4,6-trinitrofluorenone; a condensed polycyclic aromatic compound such as perillene; a diphenoquinone derivative; quinones; aldehydes; ketones; esters; acid anhydrides; phthalides; a metal complex of substituted or unsubstituted salicylic acid; a metal salt of substituted or unsubstituted salicylic acid; a metal salt of substituted or unsubstituted salicylic acid; a metal complex of aromatic carboxylic acid; and a metal salt of aromatic carboxylic acid. It is preferable to us a cyano compound, a nitro compound, a condensed polycyclic aromatic compound, a diphenoquinone derivative, a metal complex of substituted or unsubstituted salicylic acid, a metal salt of substituted or unsubstituted salicylic acid, a metal complex of aromatic carboxylic acid, or a metal salt of aromatic carboxylic acid.

The photosensitive layer of the electrophotographc photosensitive body according to the present invention may further contain any known plasticizer, oxidation inhibitor, ultraviolet absorber, or leveling agent to improve its film-forming property, flexibility, application, mechanical strength, film-forming property and durability, etc.

The photosensitive body formed as described may, of course, have an undercoat layer, intermediate layer, transparent insulating layer, surface protective layer, etc., if required.

Figure 5A:
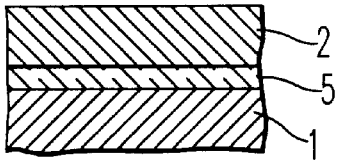
FIGS. 5*a*, 5*b*, and 5*c* are cross-sectional views illustrating the construction of photosensitive bodies having an undercoat layer, without a surface protective layer.
Figure 5B:
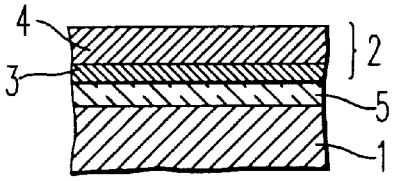
Figure 5C:
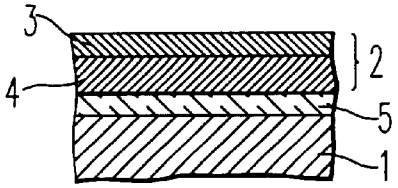

The undercoat layer is usually employed between the photosensitive layer and the conductive support (FIG. 5), and may be of any known type that is usually employed. The undercoat layer may be formed from, e.g., fine particles of inorganic materials such as titanium oxide, aluminum oxide, zirconia, and silicon oxide, fine particles of organic materials, a polyamide resin, a phenolic resin, a melamine resin, casein, a polyurethane resin, an epoxy resin, cellulose, nitro cellulose, polyvinyl alcohol, polyvinyl butyral, or other resins. These fine particles, or resins may be used along, or as a mixture or two or more kinds of materials. It has a thickness of usually 0.01 to 50 microns, and preferably 0.01 to 10 microns. A known blocking layer may be formed between the photosensitive layer and the conductive support.

In the event that a surface protective layer is formed on the photosensitive body of this invention, it may have a thickness of 0.01 to 20 microns, and preferably 0.1 to 10 microns. The binder, as mentioned before, can be used for the protective layer, and it may further contain the charge generating or transport agent, or additives as mentioned before, or a conductive material such as metal or metal oxide. The wax may be added in the amount of 0.01 to 30%, and preferably 0.1 to 10% by weight, based on the total dry weight of the surface protective layer.

The electrophotographic photosensitive body made as described is a photosensitive body which can maintain a high printing resistance for a long period of time, and is suitable for use in the fields of electrophotography, such as copying machines, printers, facsimiles, and plate making machines. A general discussion of electrophotography (photocopying) is given in *Kirk-Othmer, Encyclopedia for Chemical Technology,* 4th ed., vol. 9, pp. 245–277, Wiley, N.Y. (1994), and a brief description of laser beam printing is provided in *Encyclopedia of Electronics,* 2nd ed., Gibilisco et.al., Eds. pp. 669–671, TAB BOOKS, Blue Rodge Summit, Pa. (1990), both of which are incorporated herein by reference.

A corona charger such as a corotron or scorotron, or a contact charger such as a charging roll or brush is, for example, used for charging the electrophotographic photosensitive body of this invention. Its exposure to light is performed by using a halogen lamp, a fluorescent lamp, a laser (semiconductor, He—Ne), an LED, an internal exposure system, etc. The step of development is carried out by employing a dry or wet developing system, such as cascade development, one-component insulating toner development, one-component conductive toner development or two-component magnetic brush development.

The step of transfer is carried out by employing an electrostatic transfer method such as corona, roller or belt transfer, a pressure transfer method, or an adhesive transfer method. Fixing is carried out by hot roller fixing, flash fixing, oven fixing, pressure fixing, etc. Cleaning is carried out by using a brush cleaner, a magnetic brush cleaner, an electrostatic brush cleaner, a magnetic roller cleaner, a blade cleaner, etc.

Other features of the invention will become apparent in the course of the following descriptions of exemplary embodiments which are given for illustration of the invention and are not intended to be limiting thereof. The "parts" in the examples mean "parts by weight."

EXAMPLES

Example 1

Formation of a Charge Generating Layer 10 parts of the azo compound charge generating material (CGM) having the structure shown below were added to 150 parts of 4-methoxy-4-methylpentanone-2, and their crushing and dispersion treatment were carried out in a sand-grinding mill.

Azo Compound:

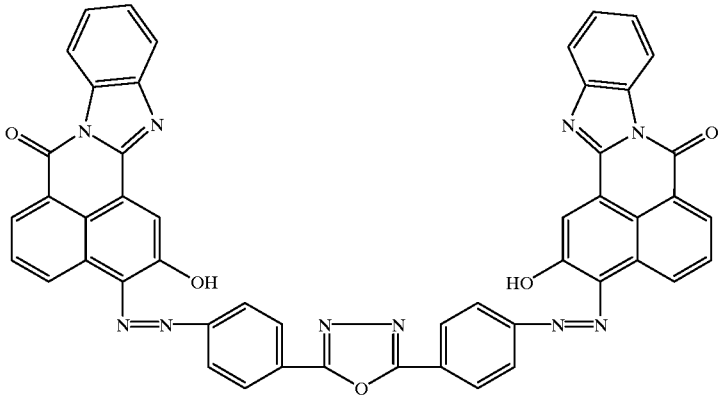

The resulting pigment dispersion was added to a mixed solution consisting of 100 parts of a 5% by weight 1,2-dimethoxyethane solution of polyvinyl butyral (product of Denki Kagaku Kogyo K.K. having the tradename #6000-C) and 100 parts of a 5% by weight dimethoxyethane solution of a phenoxy resin (product of Union Carbide Corp. having the tradename PKHH) to prepare a dispersion having a final solid content of 4.0% by weight.

This solution was used to form a charge generating layer (CGL) by the dip coating of an aluminum cylinder having an outside diameter of 30 mm, a length of 348 mm, and a wall thickness of 1.0 mm to form a CGL having a dry thickness of 0.4 g/m$^2$ (about 0.4 micron).

Formation of a Charge Transport Layer

The charge transport layer (CTL) was coated by dipping the CGL-coated cylinder in a solution prepared by dissolving 95 parts of the charge transfer material (CTM) shown below, (T-1); 1.5 parts of the cyano compound shown below, (C-1); 5 parts of the wax shown below, (W-1; a condensation product of nonanediol, sebacic acid and stearyl alcohol); and 100 parts of polycarbonate (IUPILON Z-200, a poly[1,1-bis(4-phenylene)cyclohexane carbonate] having an Mn of 19,259, an Mw of 61,359 and an Mz of 94,222, sold by Mitsubishi Gas Chemical of Japan) in 100 parts of a mixed solvent of tetrahydrofuran and dioxane (60 parts of tetrahydrofuran and 40 parts of 1,4-dioxane).

T-1 (PY-DPH):

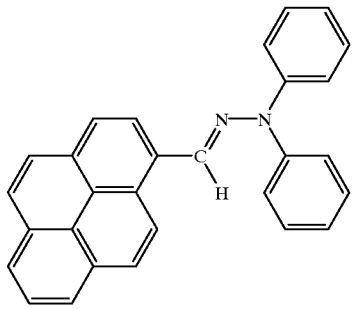

-continued

C-1 (3CS-CVB):

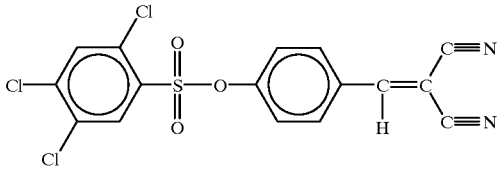

W-1:

$CH_3(CH_2)_{16}OC(=O)(CH_2)_8C(=O)O(CH_2)_9OC(=O)(CH_2)_8C(=O)O(CH_2)_{16}CH_3$

The CTL was dried at 125° C. for 25 minutes to form a CTL having a dry thickness of 21 microns.

Example 2

A photosensitive body was prepared by repeating Example 1, except that 5 parts of the compound shown below (W-2; condensation product of behenic acid and neopentyldiol) was used as the wax in place of W-1.

W-2:

$CH_3(CH_2)_{20}C(=O)OCH_2C(CH_3)_2CH_2OC(=O)(CH_2)_{20}CH_3$

Comparative Example 1

A photosensitive body was prepared by repeating Example 1 but without using any wax.

The electrophotographic photosensitive bodies prepared in Examples 1 and 2 and Comparative Example 1 were mounted in a commercially available copying machine (product of Sharp Corp., SF7850), and tested by making 30,000 copies. The change in the thickness of the photosensitive layer, as measured with a Fischer-Scope, are shown in Table 1.

TABLE 1

| Example | CTM | Wax | Thickness Down (μm/10 Kc) |
|---|---|---|---|
| Example 1 | T-1 | W-1 | 1.06 |
| Example 2 | T-1 | W-2 | 1.02 |
| Comparative Example 1 | T-1 | None | 1.32 |

Example 3

An aluminum cylinder having an outside diameter of 30 mm, a length of 357 mm, and a wall thickness of 1.0 mm was dip coated with the same charge generating layer solution used in Example 1 to form a charge generating layer having a dry thickness of 0.4 g/m$^2$ (about 0.4 micron). Then, the charge transport layer was formed by dip coating in a solution prepared by dissolving 90 parts of the CTM as shown below, (T-2); 0.5 part of the cyano compound used in Example 1, (C-1); 2 parts of the wax used in Example 1, (W-1); and 100 parts of the polycarbonate resin used Example 1, Z-200; in 100 parts of the mixed solvent of tetrahydrofuran and dioxane used in Example 1, and it was dried at 125° C. for 25 minutes to form a charge transport layer having a dry thickness of 28 microns.

T-2:

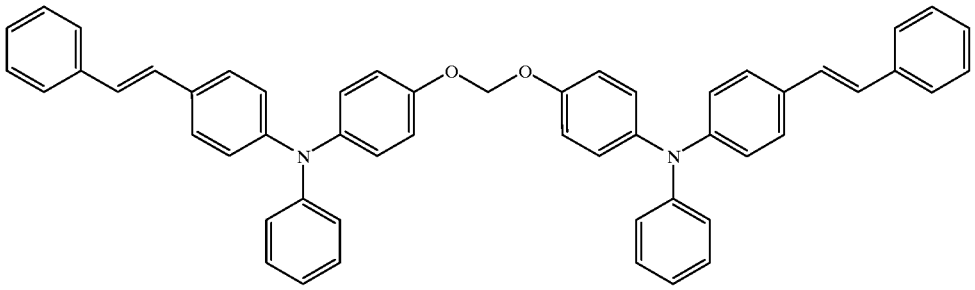

Comparative Example 2

A photosensitive body was prepared by repeating Example 3, but without using any wax.

The electrophotographic photosensitive bodies prepared in Example 3 and Comparative Example 2 were mounted in a commercially available copying machine (product of Canon Inc., NP6031), and tested by making 50,000 copies. The changes in the thickness of the photosensitive layer, as measured with a Fischer-Scope, are shown in Table 2.

TABLE 2

| Example No. | CTM | Wax | Thickness Down (μm/10 Kc) |
|---|---|---|---|
| Example 3 | T-2 | W-1 | 2.30 |
| Comparative Example 2 | T-2 | None | 2.71 |

Example 4

A polyester film having a thickness of 75 microns and carrying aluminum vapor deposited thereon was used as a conductive support, and the same CGL solution used in Example 1 for forming the charge generating layer was applied thereto by a wire bar and dried to form a charge generating layer having a dry weight of 0.4 g/m$^2$ (about 0.4 micron).

The charge transport layer was coated by an applicator with a CTL solution identical to that used in Example 1 except that it contained 100 parts of CTM (T-1) and no cyano compound (C-1), and it was dried at room temperature for 30 minutes and at 125° C. for 20 minutes to form a charge transport layer having a dry thickness of 20 microns.

Example 5

A photosensitive body was prepared by repeating Example 4, except that 5 parts of W-2 was used as the wax.

Comparative Example 3

A photosensitive body was prepared by repeating Example 4, but without using any wax.

Example 6

A photosensitive body was prepared by repeating Example 4, except that 100 parts of T-2, rather than T-1 were used as the CTM.

Example 7

A photosensitive body was prepared by repeating Example 4, except that 100 parts of T-2, rather than T-1 were used as the CTM, and 5 parts of W-2 were used as the wax in place of W-1.

Comparative Example 4

A photosensitive body was prepared by repeating Example 6, but without using any wax.

Comparative Example 5

A photosensitive body was prepared by repeating Example 6, except that 5 parts of polyethylene wax LANC)-WAX (product of Sansho Co., Ltd.) (W-3) were used as the wax in place of W-1.

Comparative Example 6

A photosensitive body was prepared by repeating Example 6, except that 5 parts of a ketone-based wax (W-4) were used as the wax in place of W-1.

W-4:

$CH_3(CH_2)_{16}CO(CH_2)_{16}CH_3$

The electrophotographic photosensitive bodies prepared in Examples 4–6 and Comparative Examples 3–6 were mounted in an apparatus for determining the characteristics of a photosensitive body (product of Kawaguchi Electric Co., Ltd., Model EPA8100), and were charged with an electric current of 50 * A flowing to their aluminum surfaces, exposed to light, and de-electrified, while they were examined for chargeability (Vo); a lowering of potential (dark damping, DD) as found two seconds after the start of charging; half-life exposure ($E_{1/2}$, standard potential: −450 V); and residual potential (Vr). The results are shown in Table 3.

TABLE 3

| Example No. | CTM | Wax | Vo (−V) | DD (V/s) | E½ (lux · sec) | Vr (−V) |
|---|---|---|---|---|---|---|
| Ex. 4 | T-1 | W-1 | 1077 | 26 | 1.10 | 30 |
| Ex. 5 | T-1 | W-2 | 1015 | 34 | 1.08 | 28 |
| Comp. Ex. 3 | T-1 | None | 1029 | 26 | 1.03 | 22 |
| Ex. 6 | T-2 | W-1 | 1082 | 28 | 0.90 | 6 |
| Ex. 7 | T-2 | W-2 | 1065 | 30 | 0.91 | 2 |
| Comp. Ex. 4 | T-2 | None | 1008 | 41 | 0.90 | 3 |
| Comp. Ex. 5 | T-2 | W-3 | 1010 | 30 | 2.20 | 95 |
| Comp. Ex. 6 | T-2 | W-4 | 1030 | 32 | 2.10 | 107 |

Example 8

The solubility properties of certain waxes in tetrahydrofuran (THF) and certain charge transport (CT) solutions were determined, and the results are reported in Table 4. The results for the solubilities in THF reported in Table 4 were determined for a mixture which contained 20 wt. % of wax and 80 wt. % of THF, based on the total weight of the wax and THF. The results for the solubility in the CT solution (1) reported in Table 4 were determined for mixtures which contained 10 parts by weight of wax per 280 parts by weight of the total weight of the CT solution, excluding the wax. The results for the solubility in the CT solution (2) reported in Table 4 were determined for mixtures which contained 10 parts by weight of wax per 278.5 parts by weight of the total weight of the CT solution, excluding the wax. The results for the solubility in the CT solution (3) reported in Table 4 were determined for mixtures which contained either 0.5, 1, 5 or 10 parts by weight of wax per 298.5 parts by weight of the total weight of the CT solution, excluding the wax. The CTL solutions in these tests are described in Tables 5A, 5B, and 5C.

TABLE 4

| | Solubility | | | |
|---|---|---|---|---|
| Wax | THF | CT Solution (1) | CT Solution (2) | CT Solution (3) |
| Candellila | Requires warming to 50° C. and stirring | Soluble | Phase separation on drying | — |
| Carnauba | Precipitates from solution at room temperature | — | — | — |
| Fully Hydrogenated Castor Oil | Soluble at room temperature | Soluble | Soluble | Phase separation with 10 parts by weight of wax Clear film with 5 parts by weight of wax |
| Cetyl Palmitate | Soluble at room temperature | Soluble at room temperature | Soluble at room temperature | Soluble at room temperature with 10 parts by weight of wax Clear film on drying with 0.5 and 1 parts by weight of wax |

TABLE 5A

| Material | Parts by weight |
|---|---|
| Polycarbonate blend of IUPILON Z-200 and IUPILON Z-800 | 60/40 (100 total) |
| CTM T-2 | 70 |
| Antioxidant: Irganox 1076 | 8 |
| C-1 | 2 |
| THF/1,4-Dioxane | 65/35 (100 total) |

TABLE 5B

| Material | Parts by weight |
|---|---|
| Polycarbonate blend of IUPILON Z-200 and | 60/40 (100 total) |
| CTM blend of CZ-DPH and ET-DPH | 56/14 (70 total) |
| Antioxidant: Irganox 1076 | 8 |
| C-1 | 0.5 |
| THF/1,4-Dioxane | 65/35 (100 total) |

TABLE 5C

| Material | Parts by weight |
|---|---|
| Polycarbonate $BPC_{(L)}$-PCR | 100 total |
| CTM PY-DPH | 90 |
| Antioxidant: BHT | 8 |
| C-1 | 0.5 |
| THF/1,4-Dioxane | 65/35 (100 total) |

Polycarbonates

IUPILON Z-200, a poly[1,1-bis(4-phenylene) cyclohexane carbonate] having a $M_n$ of 19,259, a $M_w$ of 61,359 and a $M_z$ of 94,222, sold by Mitsubishi Gas Chemical of Japan.

IUPILON Z-800, a poly[1,1-bis(4-phenylene) cyclohexane carbonate] having a $M_n$ of 36,370, a $M_w$ of 279,545 and a $M_z$ of 502,364, sold by Mitsubishi Gas Chemical of Japan.

$BPC_{(L)}$—PCR a poly[2,2-bis-(4-(3-methylphenylene)) propane carbonate] having a $M_n$ of 27,000 to 31,000, a $M_w$ of 82,000 to 95,000, a $M_z$ of 135,000 to 150,000, a $M_p$ of 75,000 to 91,000, and a Dispersion of 3.00 to 3.10, manufactured by Mitsubishi Chemical Co.

CTMs:

CZ-DPH:

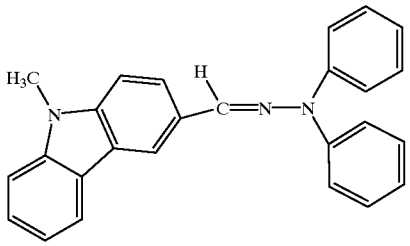

-continued

ET-DPH:

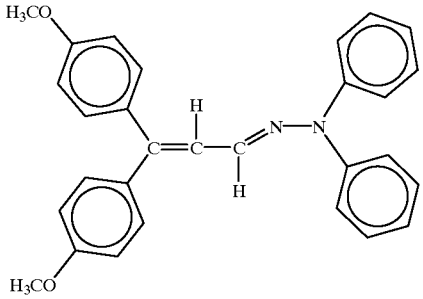

Antioxidants:

Irganox 1076:

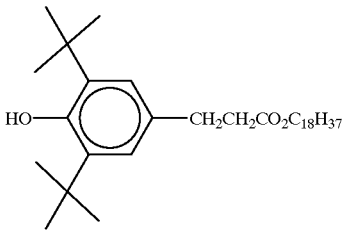

BHT:

Butylated Hydroxytoluene

According to this invention, there is obtained an electrophotographic photosensitive body which can withstand a long period of repeated use without getting substantially worn, and is excellent in cleaning and scratch resistance, while retaining other properties including electrical properties and applicability.

Obviously, numerous modifications and variations of the present invention are possible in light of the above teachings. It is therefore to be understood that, within the scope of the appended claims, the invention may be practiced otherwise than as specifically described herein.

What is claimed is:

1. An electrophotographic photosensitive body having an outermost layer and comprising:

(1) an electrically conductive support; and (2) a photosensitive layer; wherein said photosensitive layer comprises a charge generation layer and a charge transport layer; and wherein said outermost layer comprises a wax selected from the group consisting of cetyl palmitate, stearyl stearate, behenyl behenylate, cetyl myristate, palmityl hexadecylate, pentaerythritol tetrastearate, pentaerythritol tetrabehenate, pentaerythritol dibehenate, pentaerythritol tribehenate, neopentyl glycol dibehenate, a condensation product of nonanediol, sebacic acid and stearyl alcohol, and a condensation product of decanediol, azelaic acid and stearyl alcohol, wherein said outermost layer is a charge transport layer.

2. The electrophotographic photosensitive body of claim 1, wherein said wax is present in said charge transport layer in an amount of 0.01 to 30% by weight, based on the total dry weight of said charge transport layer.

3. The electrophotographic photosensitive body of claim 1, wherein said wax is present in said charge transport layer in an amount of 0.1 to 10% by weight, based on the total dry weight of said charge transport layer.

4. The electrophotographic photosensitive body of claim 1, wherein said wax is cetyl palmitate.

5. The electrophotographic photosensitive body of claim 1, wherein said wax is stearyl stearate.

6. The electrophotographic photosensitive body of claim 1, wherein said wax is behenyl behenylate.

7. The electrophotographic photosensitive body of claim 1, wherein said wax is cetyl myristate.

8. The electrophotographic photosensitive body of claim 1, wherein said wax is palmityl hexadecylate.

9. The electrophotographic photosensitive body of claim 1, wherein said wax is pentaerythritol tetrastearate.

10. The electrophotographic photosensitive body of claim 1, wherein said wax is pentaerythritol tetrabehenate.

11. The electrophotographic photosensitive body of claim 1, wherein said wax is pentaerythritol dibehenate.

12. The electrophotographic photosensitive body of claim 1, wherein said wax is pentaerythritol tribehenate.

13. The electrophotographic photosensitive body of claim 1, wherein said wax is neopentyl glycol dibehenate.

14. The electrophotographic photosensitive body of claim 1, wherein said wax is a condensation product of nonanediol, sebacic acid and stearyl alcohol.

15. The electrophotographic photosensitive body of claim 1, wherein said wax is a condensation product of decanediol, azelaic acid and stearyl alcohol.

16. The electrophotographic photosensitive body of claim 1, wherein said wax has a heat absorption peak in the range of 40° C. to 130° C. as measured by differential scanning calorimetry.

17. The electrophotographic photosensitive body of claim 1, wherein said wax has a heat absorption peak in the range of 60° C. to 120° C. as measured by differential scanning calorimetry.

* * * * *